United States Patent [19]

Panek

[11] 3,980,369

[45] Sept. 14, 1976

[54] SUBMERSIBLE PUMP INTERCONNECTION ASSEMBLY

[75] Inventor: George J. Panek, Phoenix, Ariz.

[73] Assignee: International Telephone and Telegraph Corporation, New York, N.Y.

[22] Filed: Dec. 15, 1975

[21] Appl. No.: 641,144

[52] U.S. Cl. ..... 339/28; 339/94 M; 339/117 R

[51] Int. Cl.[2] ..... H01R 11/04

[58] Field of Search ..... 339/28, 29, 94, 117

[56] References Cited

UNITED STATES PATENTS

| | | | |
|---|---|---|---|
| 3,621,447 | 11/1971 | Taylor et al. | 339/94 M |
| 3,736,548 | 5/1973 | Double | 339/94 A |
| 3,845,450 | 10/1974 | Cole et al. | 339/94 M |

*Primary Examiner*—Joseph H. McGlynn
*Attorney, Agent, or Firm*—Thomas L. Peterson

[57] ABSTRACT

An assembly for interconnecting a submersible pump motor, such as used in an oil well downhole, to a power cable which extends to the surface of the hole. The assembly comprises an elongated, flexible, liquid and gas impervious metallic tube, which is flattened between its ends. A plurality of electric conductors are disposed in side-by-side relationship between the flat walls of the tube. Electrical connector members are connected to the ends of the tube. A dielectric liquid is introduced through a filling port in one of the connector members to fill the voids in the tube and thereby provide pressure compensation between the interior and exterior of the tube.

8 Claims, 7 Drawing Figures

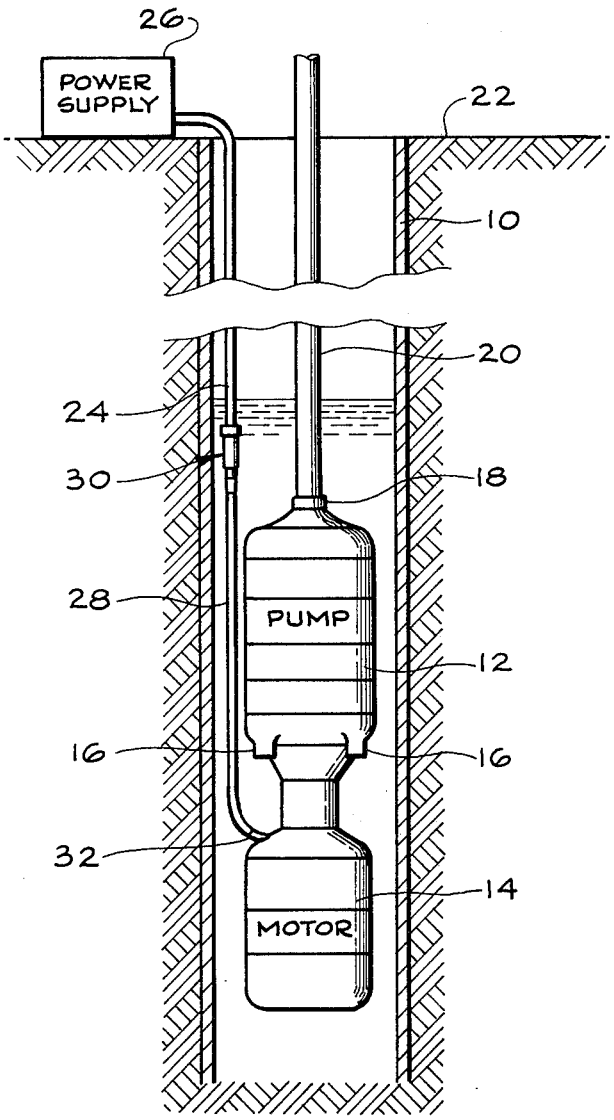
FIG. 1.
FIG. 4.
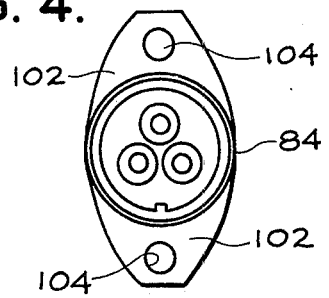
FIG. 5.
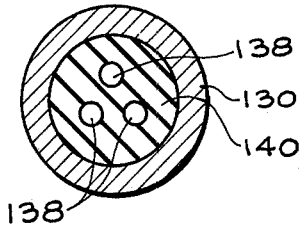
FIG. 7.
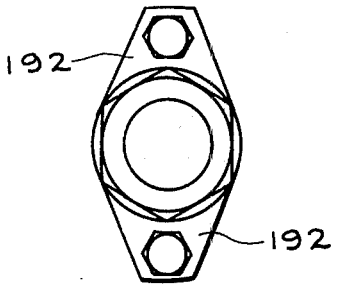

SUBMERSIBLE PUMP INTERCONNECTION ASSEMBLY

BACKGROUND OF THE INVENTION

The present invention relates generally to an electrical interconnection assembly and, more particularly, to such an assembly for interconnecting a submersible pump motor in a downhole to a power cable which extends to the surface of the hole.

While the present invention will be described herein specifically in connection with oil well downhole applications, it will be appreciated that the invention could likewise be used in gas or water wells and in connection with electrical or electronic apparatus other than motor-driven submersible pumps. In oil well downhole applications, the motor for the submersible pump is located below the pump. Thus, the electrical interconnection between the motor and the surface of the downhole must extend upwards past the pump and its accessories to the power cable which leads to the surface of the downhole. This distance may be 12 to 125 feet depending upon the number of stages in the pump. There is very limited space between pump housing and its accessories, and the oil well casing.

In the past, the electrical interconnection assembly for such an application utilized a flat cable with three conductors laid side-by-side, insulated and encased in spirally wrapped monel or phosphor bronze armor. The conductors of the fllat cable assembly were spliced to the electrical leads of the motor for the pump, and the slices were encased in a pothead and potted to provide a seal. In some cases, the conductors have been terminated to a three-pin connector, which is potted or molded, and connected to a mating connector in the motor housing. The opposite end of the conductors have been similarly spliced to the round power cable which extends to the surface of the downhole.

The above described prior art flat cable interconnection assembly has the disadvantage that is flat cable armor is easily subject to damage because of abrasion as it is lowered and withdrawn from the well casing thus causing failure of the electrical connection to the submersible pump motor. Another, more serious cause of failure is leakage due to the difficulty of sealing the armor of the flat cable assembly and electrical termination thereof against up to 5,000 psi crude oil, water, brine, and/or hydrogen sulfide at temperatures up to 310°F. Frequently, due to leakage which occurs in the armor of the flat cable assembly, when the power cable with the flat cable assembly attached thereto is withdrawn from the well and approaches ambient external pressures, the flat cable ruptures or even explodes because of internal pressures developed when the assembly is subjected to the high temperatures and pressures in the lower end of the well. It is the purpose of the present invention to provide an interconnection assembly for submersible motor driven pumps which is less subject to abrasion and rupture than the prior art assemblies discussed hereinabove.

SUMMARY OF THE INVENTION

According to the principal aspect of the present invention, there is provided an interconnection assembly for a submersible motor driven pump or the like comprising a flat cable assembly having an elongated, flexible, liquid and gas impervious, metallic tube with cylindrical ends. The tube is flattened between its ends to provide closely spaced generally parallel flat walls. A plurality of electrical conductors, typically three, extend lengthwise through the tube and are disposed in side-by-side relationship between the flat walls thereof. Electrical connector members are connected to each end of the tube in sealing relationship therewith. A filling port is provided in one of the connector members. A dielectric liquid is introduced through the filling port to fill any voids in the tube and connector members connected thereto to provide pressure compensation between the interior and exterior of the tube to insure that the tube will not collapse regardless of external pressures. Furthermore, since the tube is formed of a liquid and gas impervious metal, gases and liquids in the oil well casing will not penetrate into the tube, even at the high temperatures and pressures encountered in most applications, thus overcoming the problem of the flat cable rupturing or exploding when it is withdrawn from the casing as frequently occurs in prior art cables. In addition, the metal tube utilized for the casing of the flat cable assembly in the present invention is much less subject to damage due to abrasion as it is lowered and withdrawn from the casing than is an armor clad cable as presently used.

BRIEF DESCRIPTION OF THE DRAWINGS

FIG. 1 is a schematic illustration of a downhole oil well casing containing a motor driven pump with an electrical cable arrangement embodying the flat cable interconnection assembly of the present invention shown coupled to the motor for the pump;

FIG. 4 is an end view of the flat cable assembly illustrated in FIG. 3;

FIG. 5 is a transverse sectional view taken along line 5—5 of FIG. 2, showing details of structure of the sealing region of the cable connecting plug;

FIG. 7 is a rear view of the cable connecting plug illustrated in FIG. 6.

DESCRIPTION OF THE PREFERRED EMBODIMENTS

Figure 2:
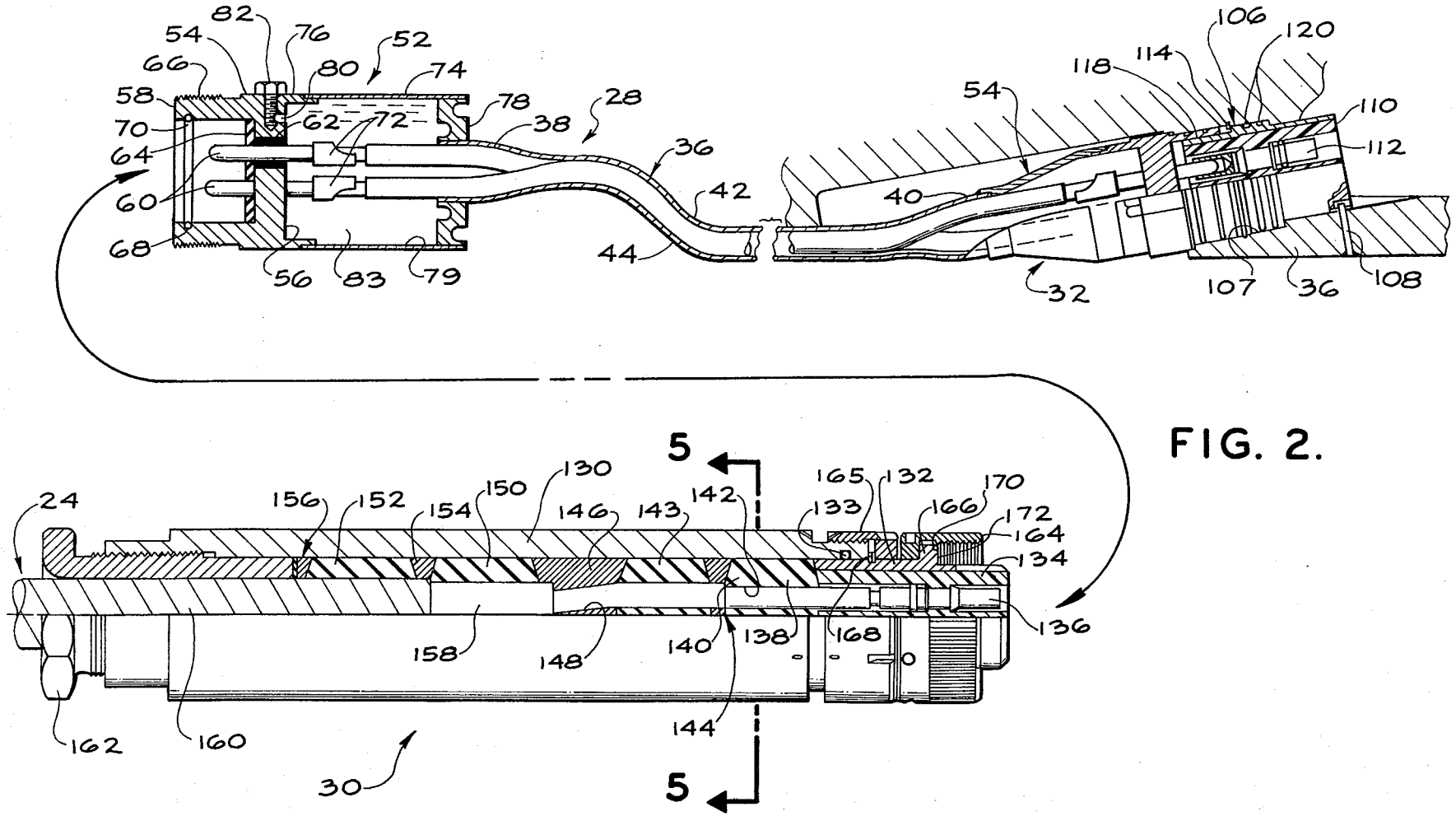
FIG. 2 is an exploded view of the electrical cable arrangement utilized in FIG. 1 showing the falt cable assembly of the present invention in partial longitudinal section, with one end of the assembly coupled to a connector member in a pump housing, shown in fragmentary form, and a cable connecting plug, shown in partial longitudinal section, which is connected to the opposite end of the flat cable assembly.

Referring now to FIG. 1 of the drawings in detail, there is schematically illustrated an oil well downhole containing a casing 10. A multi-stage pump 12 is mounted in the lower end of the casing. The pump is driven by a multi-stage motor 14 located below the pump. Inlet ports 16 are provided at the lower end of the pump. The outlet 18 of the pump is connected to a supply pipe 20, which extends to the surface 22 of the ground. A power cable 24 extends from a power supply 26 at ground level to the lower end of the casing 10. A flat cable interconnection assembly, generally disignated 28, which embodies some of the novel features of the present invention, is connected at its upper end to the power cable 24 by a cable connecting plug, generally designated 30, which also embodies certain novel features in accordance with the invention. The lower end of the flat cable assembly 28 is connected to the motor 14 at 32.

Figure 3:
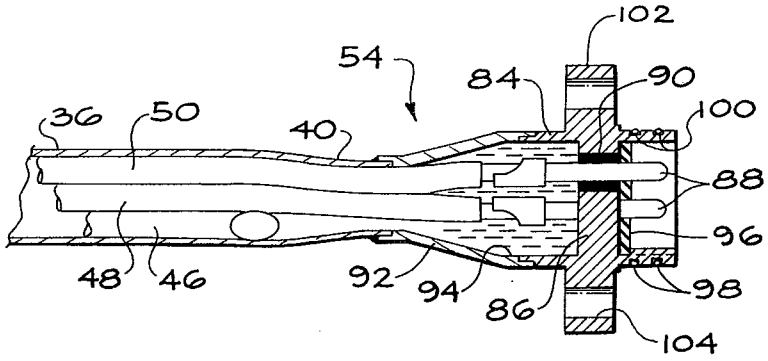
FIG. 3 is a partial longitudinal sectional view of the end of the flat cable assembly which is coupled to the motor, shown rotated 90° from the position illustrated in FIG. 2.

Reference is now made to FIG. 2 of the drawings in detail, which illustrate the electrical interconnection arrangement 34 of the present invention, including the flat cable interconnection assembly 28, the cable connecting plug 30, and the electrical coupling 32 of the flat cable to the housing 36 of the motor 14. The flat cable assembly 28 comprises a gas and liquid impervious, elongated flexible cylindrical tube 36 which has been flattened between its opposite ends 38 and 40 to provide a pair of generally parallel flat walls 42 and 44. The distance between the walls 42 and 44 of the flat cable is sufficiently small to allow the cable to be freely positioned between the pump 12 and oil well casing 10, as iillustrated in FIG. 1, and without being subject to significant abrasion due to movement of the pump within the well. A plurality of insulated conductors, typically 3, designated 46, 48, and 50, are located within the flat tube 36. The conductors are disposed in side-by-side relationship within the tube as illustrated in FIG. 3. The outer diameter of the conductors is appproximately equal to the distance between the inner surfaces of the walls 42 and 44. The opposite ends of the tube 36 are terminated by electrical connector members 52 and 54, respectively.

The connector member 52 comprises a cylindrical receptacle shell 54 having a header 56 spaced from the outer end 58 of the shell. Three contacts 60 are mounted in the header 56 by glass compression seals 62, only one being visible in FIG. 2. An elastomeric interfacial seal 64 is mounted on the outer face of the header 56. The contacts 60 extend through the interfacial seal in sealing relationship therewith. The outer surface of the shell 54 is threaded as indicated at 66. An annular groove 68 is formed in the inner surface of the shell 54 between the end 58 of the shell and the header 56. An elastomeric sealing ring, such as an O-ring 70, is positioned in the groove 68. The rear ends 72 of the contacts 60 are terminated to the conductors within the tube 36 by any suitable means such as crimping or soldering.

A cylindrical sleeve 74 surrounds the rear end 72 of the contacts and is welded at its forward end to a rearwardly extending cylindrical extension 76 on a receptacle shell 54. The opposite end of the sleeve 74 is welded to a ring 78, which in turn is welded to the cylindrical end 38 of the tube 36, providing a cavity 79. A filling port 80 in the header 56 extends from the cavity 79 to the outer surface of the header. A threaded plug 82 closes the port 80. The welded joints between the sleeve 74 and the receptacle shell 54 and ring 78, and the welded joint between the ring 78 and the tube 36 provides a hermetically sealed connection between the connector member 52 and the flattened tube 36. In order to withstand the high pressures encountered in an oil well casing, in the order of 5,000 psi, a dielectric fluid 83 is introduced into the cavity 79 through the port 80 by removing the plug 82. Sufficient fluid is introduced into the cavity to fill all the voids between the connectors 46, 48, and 50, and the tube 36 as well as any voids within the connector member 54 at the opposite end of the tube, to be described in detail later.

The dielectric fluid provides pressure compensation to avoid collapsing of the metallic tube 36 under pressure. Preferably the thickness of the wall of the metallic tube 36 is sufficiently small so that the wall will flex so as to provide equalization of exterior and internal pressure. Alternatively, the ring 78 could be in the form of a bellows.

The connector member 54 at the opposite end of the flat tube 36 is somewhat similar to the connector member 52 and comprises a plug shell 84 having a header 86 in which there are mounted pin contacts 88 by glass compression seals 90, only one being visible in FIG. 2. The contacts 88 are terminated to the conductor 46, 48, and 50, in the same manner as the contacts 60 in the connector member 52. A skirt 92 is welded at one end to the rear of the shell 84 and at its other end to the cylindrical end 40 of the tube 36, as best seen in FIG. 3. The shell 84 and skirt 92 define a cavity 94 surrounding the rear terminating ends of the contacts 88. This cavity becomes filled with the dielectric fluid 83 which is introduced into the cavity 79 through the port 80. An elastomeric interfacial seal 96 is formed on the outer surface of the header 86. O-rings 98 are mounted in annular grooves 100 in the outer surface of the forward end of the shell 84.

Opposed outwardly extending flanges 102 are integrally formed on the shell 84. The flanges contain openings 104 for receiving screws, not shown, which secure the connector 54 to a mating connection member receptacle shell 106 fixedly mounted in a bore 107 in the wall 36 of the motor housing. The shell 106 is properly rotatably oriented within the housing wall by means of a polarizing pin 108 fixed within the wall. The shell 106 contains an insulator 110 in which there are mounted three socket contacts 112 positioned to mate with the pin contacts 88 of the connector member 54. A retaining ring 114 and shoulder 116 on the wall of the bore 107 cooperate to retain the shell 106 axially within the bore. The forward end 118 of the receptacle shell 106 is telescopically mounted within the forward end of the shell 84 of the mating connector member 54. The O-rings 98 on the shell 84 sealingly engage the wall of the bore 107. O-rings 102 are also provided on the shell 106 for making sealing engagement with the wall of the bore 107. Thus, an electrical and sealed connection is made between the connector 54 and the connection members mounted in the motor housing 36 without the use of any potting materials as been the practice in the oil field art in the past.

Preferably, the tube 36 of the flat cable interconnection assembly 28 is formed of stainless steel. The tube wall is impervious to both gases and liquids even at the high pressures and temperatures normally encountered in oil well casings. Furthermore, the tube is connected at each end to the connector members 52 and 54 by welded connections providing a positive, permanently leak-proof sealed assembly. As a consequence, gases and liquids cannot enter the interior of the assembly as in the presently used flat cable interconnection assemblies which results in ruptures and explosions on occasions when the assemblies are withdrawn from the oil well casing. Since the internal voids in the assembly are completely filled with dielectric fluid 83, such as oil, total pressure compensation is achieved to insure that the flattened tube 36 will not collapse regardless of external pressure. The flattened tube 36 has the further advantage that it is much less susceptible to abrasive damage than the braided armor on presently used cable connection assemblies. Further, the connectors 52 and 54 contain glass sealed contacts to further insure leak-tight integrity of the assembly.

The connector member 52, which is disposed above the connector member 54 when the flat cable assembly 28 is disposed in oil well casing, is connected to the cable connecting plug 30 that terminates the power cable 24. The plug 30 comprises an elongated cylindrical backshell 130 and a cylindrical forward shell 132, which is slidably mounted in the forward end of the backshell. An O-ring 133 provides a seal between the forward shell 132 and the backshell. The shell 132 contains an insulator 132 in which there are mounted three socket contacts 136, only one being seen in FIG. 2. The contacts are adapted to mate with the pin contacts 60 when the connector member 52 is coupled to the plug 30. The contacts 136 are crimped to the conductors 138 of the power cable 24. The rear or inner ends of the forward shell 132 and insulator 134 bear against an elastomeric sealing grommet 140 which contains three openings 142, each receiving one of the conductors 138 of cable 24 as best seen in FIG. 5. Preferably, a second identical grommet 143 is provided behind the grommet 140. A washer 144 is disposed between the grommets 140 and 143. A conductor spreader 146 is positioned behind the grommet 143. The spreader contains three openings 148, each receiving one of the conductors 138. Additional sealing grommets 150 and 152 are disposed behind the spreader 146 with a washer 154 positioned between the grommets. A thrust washer 156 is located behind grommet 152. The end surfaces of the washers 144 and 154, and of the spreader 146, taper outwardly at an angle as seen in FIG. 2 so that when an axial force is applied to thrust washer 156, the grommets 140, 143, 150, and 152 will be deformed radially inwardly to seal about the conductors 138, the cable insulation 158, and cable armor 160. Such axial compression force is provided by threading a gland nut 162 into the rear of the backshell 130.

A pair of oppositely facing coupling nuts 164 and 165 are rotatably mounted on the forward shell 132 of plug 30. The coupling nuts are axially retained on the shell by an outwardly extending flange 166 integrally formed on the shell and a retaining ring 168. The coupling nut 165 connects the forward shell 132 to the forward end of the backshell 130. The forward coupling nut 164 cooperates with the threads 66 on receptacle shell 54 to couple the connector member 52 to the plug 30. When the two connector members are mated, the O-ring 70 on the connector member 52 sealingly engages the outer surface of the forward end of forward shell 132 of plug 30.

An interfacial resilient sealing ring 170 is mounted in a tapered groove 172 formed in the outer forward end of the flange 166 of shell 132. This O-ring engages the forward end 58 of shell 54 when the connector members 52 and 30 are engaged.

From the foregoing, it is seen that the cable connecting plug 30 embodies a multi-gland sealing grommet arrangement which effectively seals the backshell to the cable 24 yet provides for a field disconnectable assembly. Further, the double coupling nut arrangement provided on the forward shell 132 with the sealing rings 70 and 170 provide a disconnectable, yet sealed interconnection between the plug 30 and the flat cable assembly 28.

Figure 6:
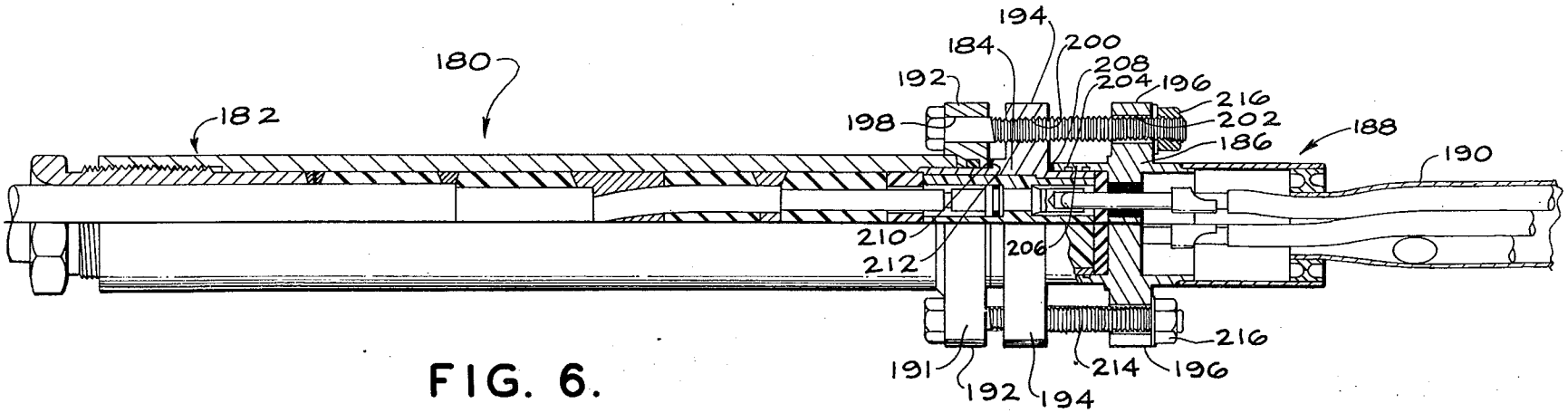
FIG. 6 is partial longitudinal sectional view through a cable connecting plug employing an alternative coupling arrangement for connecting the plug to the flat cable assembly of the invention.

Reference is now made to FIGS. 6 and 7 of the drawings which illustrate a modified form of the cable connecting plug of the present invention, generally designated 180. The plug 180 includes a backshell 182 and a forward shell 184 and interior components therein essentially identical to that embodied in the cable connecting plug 130, except that the backshell has a flat configuration. The shell 186 of the connector member 188 that is connected to the end of the flat tube 190 is essentially identical to the shell 54 of connector member 52 sealed to the end of the flattened tube 42 in FIG. 2. Accordingly, only those features of the interconnection arrangement illustrated in FIGS. 6 and 7 that differ from those illustrated in FIGS. 2 to 5 will be described. A ring 191 having a pair of oppositely extending fingers 192 is fixed, as by welding, to the forward end of the backshell 180. The forward shell 184 includes a pair of outwardly extending flanges 194 as does the shell 186 as indicated at 196. The flanges are aligned with each other and contain aligned bores 198, 200, and 202, respectively. The bores 200 are threaded, while the other bores are not. The forward end 204 of shell 186 is slidably mounted over the forward end 206 of shell 184. A deformable gasket 208, such as a lead gasket, is positioned between the end of the shell 186 and the flange 194. A second deformable gasket 210 is positioned between a rearwardly facing shoulder 212 on the shell 184 behind flange 194 and the front face of the ring 191. Bolts 214 extend through the aligned bores 198, 200, and 202. The bolts 214 are threaded in the bores 200 to secure the shell 184 to the forward end of the backshell 182 and deform the gasket 210 thereby providing an effective sealed interconnection therebetween. Nuts 216 on the ends of the bolts serve to secure the shell 186 of the connector member 188 to the plug 180. By such securement, the gasket 208 is deformed to provide a sealed connection between the mating connecting members. This modified version of the cable connecting plug has a smaller cross-section in one direction than cable connecting plug 30, shown in FIG. 2, thus allowing installation adjacent to a larger supply pipe 20.

It is claimed that:

1. A submersible pump interconnection assembly comprising:

an elongated, flexible, liquid and gas impervious, metallic tube having cylindrical ends, said tube being flattened between said ends to provide closely spaced, generally parallel, flat walls;

a plurality of electrical conductors extending lengthwise through said tube and disposed in side-by-side relationship between said flat walls;

an electrical connector member connected to each end of said tube in sealing relationship therewith;

a filling port in one of said connector members;

a dielectric liquid filling any voids in said tube and connector members to provide pressure compensation between the interior and exterior of said tube; and electical contacts in each said connector member terminated to the ends of said conductors, said contacts having a sealed mounting in their respective connector members.

2. A submersible pump interconnection assembly as set forth in claim 1 including:

an annular groove on the inner surface of said shell of one of said connector members located between the outer mating end of said shell and said header; and an elastomeric sealing ring lying in said groove.

3. A submersible pump interconnection assembly as set forth in claim 1 including:

a cable connecting plug connected to one of said connector members, said one connector member having an externally threaded receptacle shell;

said cable connecting plug including an elongated hollow backshell having an externally threaded forward end and a cylindrical forward shell slidably mounted within said forward end;

a pair of coupling nuts rotatably mounted on said forward shell, one of said coupling nuts being threaded to said forward end of said backshell and the other coupling nut being threaded to said receptacle shell;

means restricting axial movement of said coupling nuts on said forward shell; and a pluality of contact mounted in said forward shell each mated with a corresponding contact in said one connector member.

4. A submersible pump interconnection assembly as set forth in claim 1 wherein:

each said connector member comprises a metal shell having an integral header extending transversely across the shell; and compression glass seals seal said contacts in said header thereby providing said sealed mounting.

5. A submersible pump interconnection assembly as set forth in claim 4 including:

an elastomeric interfacial seal on each of said headers, said contacts extending through said seals in sealing relationship therewith.

6. A submersible pump interconnection assembly as set forth in claim 1 including:

a cable connecting plug connected to one of said connector members, said one connector member including a shell;

said cable connecting plug including an elongated hollow backshell having a forward end, an outwardly extending flange on said forward end, and a forward shell having one end slidably mounted within said forward end;

said one connector shell being telescopically mounted on the other end of said forward shell, said one connector member shell having an outwardly extending flange;

removable fastener means extending through said flanges generally parallel to the longitudinal axis of said backshell for coupling said one connector member to said forward shell; and a plurality of contact mounted in said forward shell each mated with a corresponding contact in said one connector member.

7. A submersible pump interconnection assembly as set forth in claim 6 including:

an outwardly extending flange on said forward shell;

said flanges having aligned openings therein;

said fastener means including a bolt extending through said openings, said bolt being threadedly engaged with said opening in said forward shell flange.

8. A submersible pump interconnection assembly as set forth in claim 6 including:

means on said forward shell providing forwardly and rearwardly facing annular shoulders thereon;

a first sealing member disposed between said rearwardly facing shoulder and said backshell flange;

a second annular sealing member disposed between said forwardly facing shoulder and the forward end of said one connector member shell; and said fastener means deforming said sealing members.

* * * * *